US009144838B2

(12) United States Patent
Shan et al.

(10) Patent No.: US 9,144,838 B2
(45) Date of Patent: Sep. 29, 2015

(54) FORMING MACHINE WITHOUT PATTERN CASTING

(75) Inventors: Zhongde Shan, Beijing (CN); Limin Liu, Beijing (CN); Feng Liu, Beijing (CN)

(73) Assignee: ADVANCED MANUFACTURE TECHNOLOGY CENTER, CHINA ACADEMY OF MACHINERY SCIENCE & TECHNOLOGY, Haidian District, Beijing (CN)

( * ) Notice: Subject to any disclaimer, the term of this patent is extended or adjusted under 35 U.S.C. 154(b) by 0 days.

(21) Appl. No.: 14/357,621

(22) PCT Filed: Nov. 14, 2011

(86) PCT No.: PCT/CN2011/082168

§ 371 (c)(1), (2), (4) Date: May 12, 2014

(87) PCT Pub. No.: WO2013/071479

PCT Pub. Date: May 23, 2013

(65) Prior Publication Data

US 2014/0284017 A1 Sep. 25, 2014

(51) Int. Cl.

| | |
|---|---|
| ***B22C 9/02*** | (2006.01) |
| ***B22C 23/00*** | (2006.01) |
| ***B22C 13/00*** | (2006.01) |

(52) U.S. Cl.

CPC . *B22C 9/02* (2013.01); *B22C 13/00* (2013.01); *B22C 23/00* (2013.01)

(58) Field of Classification Search

CPC ..... B22C 9/02; B22C 23/00

See application file for complete search history.

(56) References Cited

U.S. PATENT DOCUMENTS 7,185,412 B2 * 3/2007 Penick et al. ..... 29/560

FOREIGN PATENT DOCUMENTS

| | | | |
|---|---|---|---|
| CN | 85103880 | A | 11/1986 |
| CN | 101279357 | A | 10/2008 |
| CN | 102489675 | A | 6/2012 |
| CN | 202291310 | U | 7/2012 |
| EP | 1334785 | A1 | 8/2003 |

OTHER PUBLICATIONS

International Search Report dated Aug. 8, 2012; issued in International Patent Application No. PCT/CN2011/082168.

* cited by examiner

*Primary Examiner* — Kevin P Kerns
*Assistant Examiner* — Steven Ha
(74) *Attorney, Agent, or Firm* — Moore & Van Allen PLLC

(57) ABSTRACT

The disclosure provides a forming machine without pattern casting, including: a multi-axis motion system; a cutting system, connected with the multi-axis motion system; a driving system, driving the multi-axis motion system to move; and a machining base, wherein the machining base includes a fixing seat and a turnover mechanism, wherein the turnover mechanism is revolvably connected with the fixing seat. Since the forming machine without pattern casting of the disclosure adopts a tilting type and needs no working platform, most of the waste sand grains generated from cutting fall freely into the shakeout groove arranged below the fixing seat, and will not fly into the multi-axis motion system, and will not cause stop failure; thus the precision and service life of the forming machine without pattern casting are improved.

13 Claims, 7 Drawing Sheets

FORMING MACHINE WITHOUT PATTERN CASTING

TECHNICAL FIELD OF THE INVENTION

The disclosure relates to the field of casting technology, and in particular to a forming machine without pattern casting.

BACKGROUND OF THE INVENTION

Traditional casting manufacturing process has disadvantages of long manufacturing cycle, high production cost and large consumption of resources. However, non-mold mould numerical control machining forming technology solves these problems.

The non-mold mould numerical control machining forming technology, which systematically integrates Computer Aided Design (CAD) technology, casting technology, numerical control technology, cutting technology and other technologies, is a brand new fast mould manufacturing technology. A forming machine without pattern casting employing this technology might process a sand billet to make various shapes of casting sand moulds without using a mould, and thus provides a new carrier for the trail production of single-piece or small-batch castings. The application of this device also can shorten production cycle and improve production efficiency, thus this device is particularly suitable for the machining of small-batch complex moulds.

Existing forming machine without pattern casting consists of a multi-axis (three axes or more) motion system, a general or special sand mould machining tool system, a sand discharging system main body and a special control software matched with a sand module cutting process. After a sand billet is fixed on this forming machine, the sand billet can be machined from a single side only; if the sand billet needs multi-side machining, the sand billet must be turned over for several times and then fixed; in this way, several times of positioning must lead to an error and finally seriously impact the machining quality of the casting sand mould. In addition, since the three-axis motion system of the device is arranged above a machining working platform, small part of sand grains generated from cutting can not be shielded by a baffle and are easy to enter the motion system, thereby causing the problem of waste sand contamination, even failure stop, and reducing the service life of the machine tool.

SUMMARY OF THE INVENTION

The purpose of the disclosure is to provide a forming machine without pattern casting which can machine a sand billet from multiple sides.

Thus, the disclosure provides a forming machine without pattern casting, including: a multi-axis motion system; a cutting system, connected with the multi-axis motion system; a driving system, driving the multi-axis motion system to move; and a machining base, wherein the machining base includes a fixing seat and a turnover mechanism, wherein the turnover mechanism is revolvably connected with the fixing seat.

Further, the forming machine without pattern casting further comprises a forming machine base which includes a baseplate and a pedestal wherein the baseplate is arranged at the lower end of the fixing seat and the baseplate is obliquely arranged on the pedestal.

Further, the baseplate includes a mounting plate arranged at the lower end of the fixing seat, and includes a front mounting plate and a back mounting plate arranged at both sides of the mounting plate respectively.

Further, the forming machine without pattern casting further comprises a outer cover which is fixedly connected on the baseplate, wherein a sealed cavity is formed inside the outer cover; the multi-axis motion system, the cutting system and the driving system all are arranged in the cavity.

Further, the turnover mechanism includes a turnover plate and a turnover clamp; one end of the turnover clamp is connected with the turnover plate, the other end of the turnover clamp is revolvably connected with the fixing seat.

Further, the fixing seat includes a first seat and a second seat; the turnover clamp includes an active disc chuck, the first end of the active disc chuck is fixedly connected with the turnover plate and the second end of the active disc chuck is revolvably inserted into a first disc mounting hole of the first seat.

Further, the second end of the active disc chuck is provided with a handle.

Further, the fixing seat includes a first seat and a second seat; the turnover clamp includes a passive disc chuck, the first end of the passive disc chuck is fixedly connected with the turnover plate and the second end of the passive disc chuck is revolvably inserted into a second disc mounting hole of the second seat.

Further, the turnover clamp further includes a locating piece, which fixes the passive disc chuck onto the second seat.

Further, the locating piece includes an end cover, which is detachably connected with the passive disc chuck through a fastening piece; one end of the end cover presses against the second seat.

Further, the locating piece further includes a locating pin; a locating pin hole is arranged on the passive disc chuck and the locating pin is pluggable arranged in the locating pin hole.

Further, there is a plurality of the locating pin holes, and an included angle is set between the locating pin holes.

Further, the turnover mechanism is provided with a sand billet fixing clamp; and the sand billet is fixedly arranged on the turnover mechanism through the sand billet fixing clamp.

Further, the turnover plate is a C-shaped plate with an opening on one side; and the sand billet is fixedly arranged in the opening of the C-shaped plate.

With the forming machine without pattern casting of the disclosure, a sand billet is fixed on the turnover mechanism and can turn over together with the turnover mechanism relative to the fixing seat in multi-angle; in this way, double-side machining or multi-side machining of the sand billet is realized. When the sand billet undergoes double-side machining or multi-side machining, the sand billet does not need to be demounted and relocated; thus, no machining error is caused.

BRIEF DESCRIPTION OF THE DRAWINGS

For a better understanding of the disclosure, accompanying drawings described hereinafter are provided to constitute one part of the application; the schematic embodiments of the disclosure and the description thereof are used to illustrate the disclosure but to limit the disclosure improperly. In the accompanying drawings.

DETAILED DESCRIPTION OF THE EMBODIMENTS

The disclosure is described below in detail by reference to accompanying drawings in conjunction with embodiments.

Figure 1:
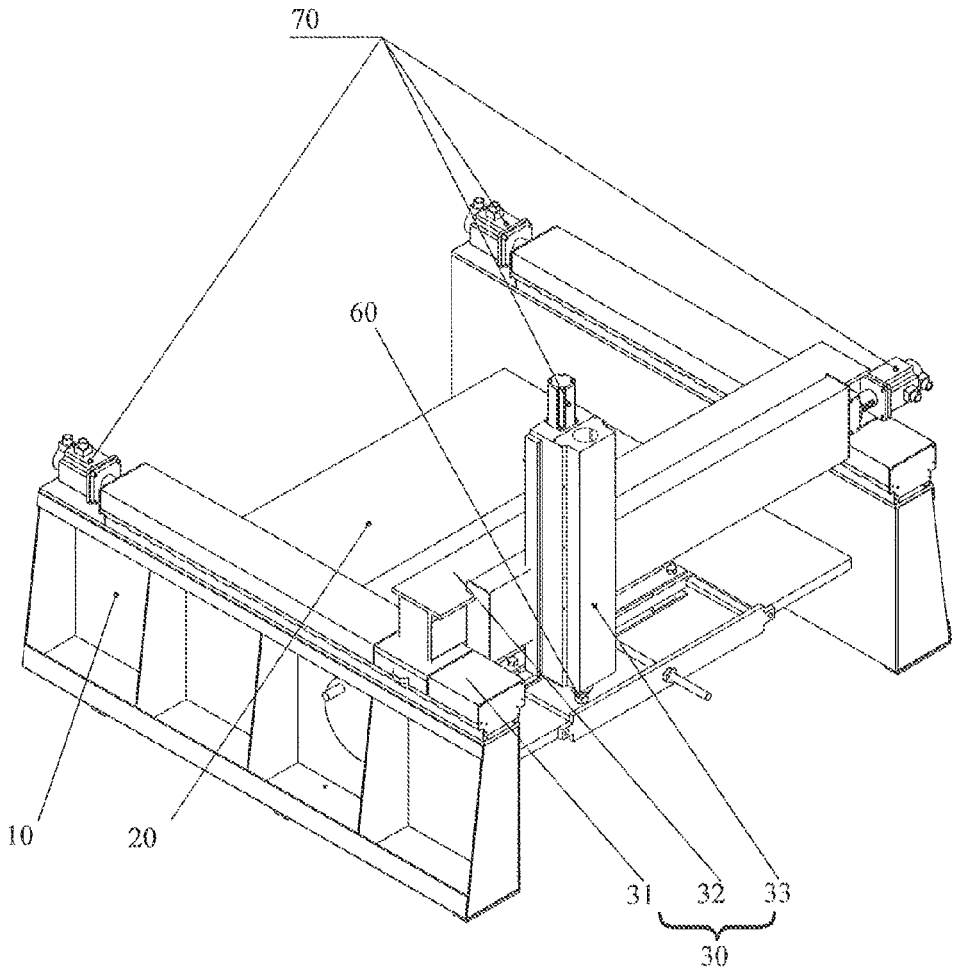
FIG. 1 shows a structure diagram of a forming machine without pattern casting of the disclosure.
Figure 2:
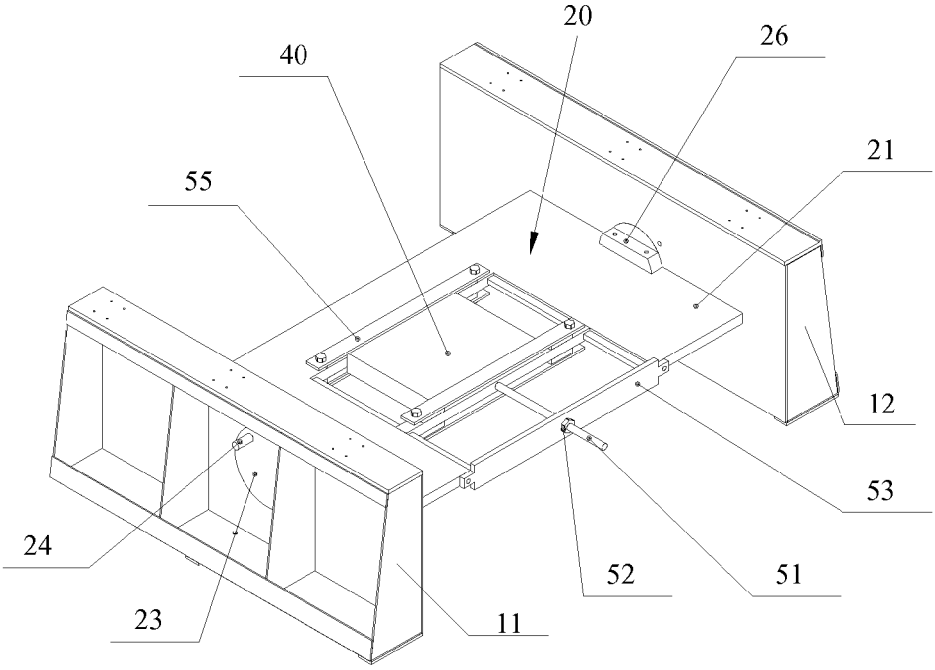
FIG. 2 shows a structure diagram of a turnover mechanism of the forming machine without pattern casting of the disclosure.

As shown in FIG. 1 and FIG. 2, a forming machine without pattern casting according to the disclosure includes: a multi-axis motion system 30, including an X-axis motion system 31, a Y-axis motion system 32 and a Z-axis motion system 33; a cutting system 60, connected with the multi-axis motion system 30; a driving system 70, driving the multi-axis motion system 30 to move; and a machining base, including a fixing seat 10 and a turnover mechanism 20, wherein the turnover mechanism 20 is revolvably connected with the fixing seat 10.

As shown in FIG. 1 and FIG. 2, the forming machine without pattern casting in this embodiment is a three-axis motion system, that is to say, the multi-axis motion system 30 includes an X-axis motion system 31, a Y-axis motion system 32 and a Z-axis motion system 33 respectively. The driving system 70 drives the multi-axis motion system 30 to move, and finally drives a cutting system 60 connected with the multi-axis motion system 30 to move and to machine a sand billet, so as to obtain various shapes of casting sand moulds.

With the forming machine without pattern casting of the disclosure, a sand billet 40 is fixed on the turnover mechanism 20 and can turn over together with the turnover mechanism 20 relative to the fixing seat 10 in multi-angle; in this way, double-side machining or multi-side machining of the sand billet 40 is realized. Therefore, when the sand billet 40 undergoes double-side machining or multi-side machining, the sand billet 40 does not need to be demounted and relocated; thus, no machining error is caused.

Specifically, refer to FIG. 1 and FIG. 2, which give an embodiment of the forming machine without pattern casting provided by the disclosure for illustration. The X-axis motion system includes a first X-axis motion system and a second X-axis motion system that are arranged in parallel. Two ends of the Y-axis motion system are slidably connected with the first X-axis motion system and the second X-axis motion system respectively. The Z-axis motion system is slidably connected with the Y-axis motion system.

In this embodiment, the driving system 70 includes: a first X-axis driving unit and a second X-axis driving unit that are arranged on one end of the first X-axis motion system and the second X-axis motion system; a Y-axis driving unit arranged on one end of the Y-axis motion system; and a Z-axis driving unit arranged on one end of the Z-axis motion system. All the driving units consist of a servo motor and a reducer, driving these motion systems to move respectively. Both of the X-axis motion systems adopt two servo motors to synchronously drive both of the X-axis motion systems through a control system.

In order to prevent sand grains from entering the multi-axis motion system, a flexible dust cover is provided on the first X-axis motion system, the second X-axis motion system, the Y-axis motion system and the Z-axis motion system respectively, to completely cover the main body of the multi-axis motion system, thereby effectively preventing the entrance of waste sand and dust, and improving the precision and service life of the forming machine without pattern casting.

Figure 8:
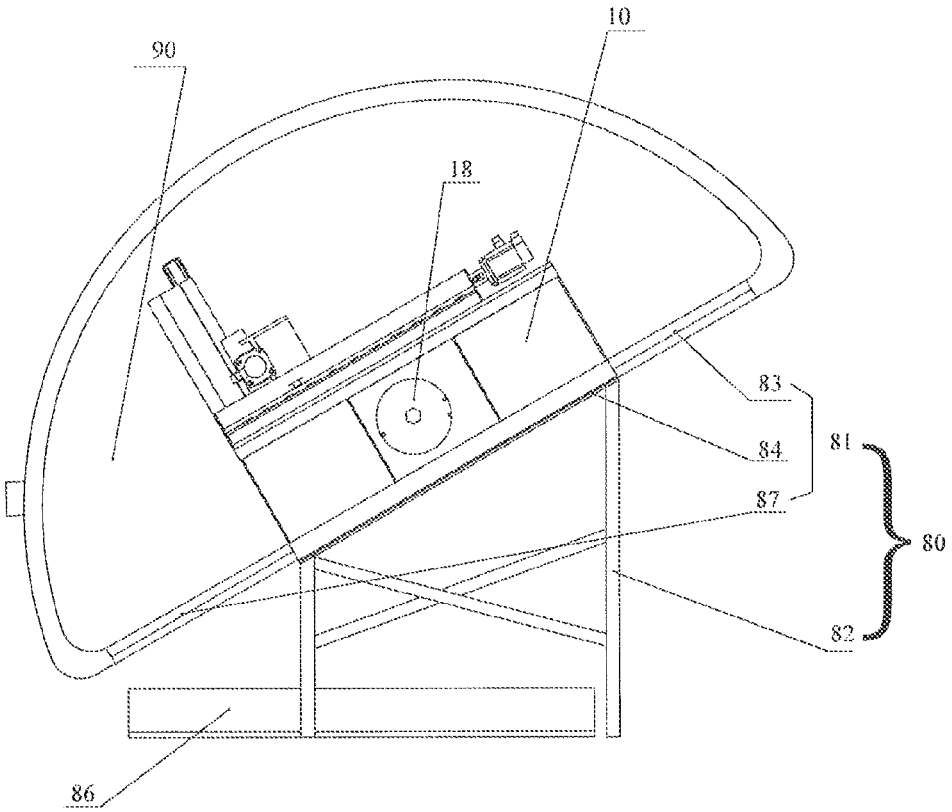
FIG. 8 shows an exterior structure diagram of the forming machine without pattern casting of the disclosure.

As shown in FIG. 8, the forming machine without pattern casting further includes a forming machine base 80 which includes a baseplate 81 and a pedestal 82, wherein the baseplate 81 is arranged at the lower end of the fixing seat 10 and the baseplate 81 is obliquely arranged on the pedestal 82. The forming machine without pattern casting further includes a sand discharging device, which includes a through sand discharging opening arranged on the baseplate 81, and a shakeout groove 86 arranged below the sand discharging opening.

The structure of the pedestal 82 of the forming machine base 80 adopts a tilting type. The baseplate 81 includes a mounting plate 84 arranged at the lower end of the fixing seat 10, and includes a front mounting plate 87 and a back mounting plate 83 which are arranged at both sides of the mounting plate 84 respectively. The mounting plate 84 forms a certain title angle relative to the ground; a first seat 11 and a second seat 12 are fixed on the mounting plate 84 through a screw respectively; the front mounting plate 87 and the back mounting plate 83 are fixed on the first seat 11 and the second seat 12 through a screw respectively. The shakeout groove 86 is arranged below the fixing seat 10, and below the sand discharging opening correspondingly. Since the machined workpiece is a sand billet, not a metal workpiece, the waste grains are easy to fly to contaminate the machining environment, and are more likely to slide down under the effect of gravity. Therefore, the forming machine without pattern casting in this embodiment does not use an integral working platform but uses a C-shaped turnover plate having an opening; thus there is no barrier; moreover, since the entire machine has a certain tilt angle relative to the ground, waste sand grains generated during machining process would slide down along the upper end face of the baseplate 81 under the effect of gravity and fall freely into the shakeout groove 86 at the bottom, thereby being convenient for workers to clear, preventing the dust flying, and improving the machining environment.

The forming machine without pattern casting further includes an outer cover 90 which is fixedly connected on the baseplate 81, wherein a sealed cavity is formed inside the outer cover 90, and the multi-axis motion system 30, the cutting system 60 and the driving system 70 all are arranged in the cavity.

The outer cover 90 of the machine tool is fixedly provided on the front mount plate 87 and the back mounting plate 83. A sealed cavity is formed inside the outer cover 90; and the multi-axis motion system 30, the driving system 70 and the machining base all are arranged in the cavity. Since the outer cover 90 adopts a sealed form, the machining process is performed in a totally enclosed environment; thus, sand grains generated during the cutting process are blocked inside the forming machine without pattern casting, causing no sand dust contamination to the workshop and improving the working environment of workers.

Figure 3:
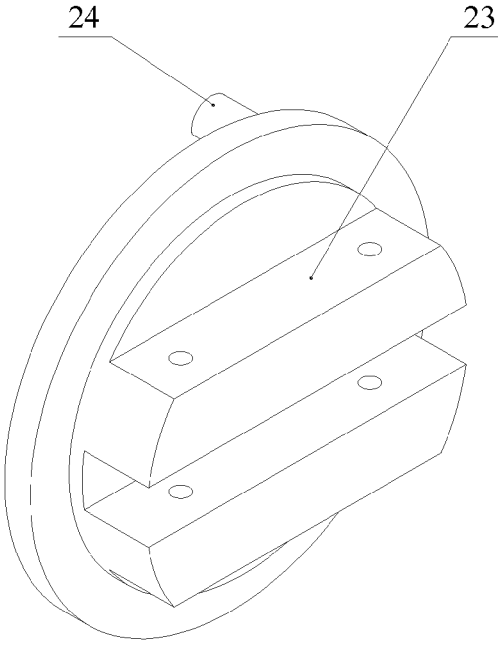
FIG. 3 shows a structure diagram of an active disc chuck of the forming machine without pattern casting of the disclosure.

As shown in FIG. 2, the fixing seat 10 includes a first seat 11 and a second seat 12; the turnover mechanism 20 includes a turnover plate 21 and a turnover clamp, wherein one end of the turnover clamp is connected with the turnover plate 21, and the other end thereof is revolvably connected with the fixing seat 10. Specifically, the turnover clamp includes an active disc chuck 23, of which the first end is fixedly connected with the turnover plate 21 and the second end is revolvably inserted into a first disc mounting hole of the first seat 11. The structure of the active disc chuck 23 is as shown in FIG. 3.

One end of the active disc chuck 23 facing the turnover plate 21 is provided with two protruding connecting blocks. A groove is provided between the two protruding connecting blocks, and the turnover plate 21 is inserted into the groove. The turnover plate 21 is in a thread connection with the active disc chuck 23. Preferably, the second end of the active disc chuck 23 is provided with a handle 24, through which an operator can drive the active disc chuck 23 to rotate; and then the active disc chuck 23 drives the turnover plate 21 to rotate, thereby driving the sand billet 40 arranged on the turnover plate 21 to rotate; in this way, the sand billet 40 can be double-side or multi-side machined without being demounted, thus the machining precision of the sand billet 40 is improved. The handle 24 is arranged at one side of the active disc chuck 23 near the outer circumference, so that the operation is more laborsaving.

As shown in FIG. 2, the turnover clamp further includes a passive disc chuck 26, of which the first end is fixedly connected with the turnover plate 21 and the second end is revolvably inserted into a second disc mounting hole of the second seat 12.

One end of the passive disc chuck 26 facing the turnover plate 21 is provided with two protruding connecting blocks. A groove is provided between the two protruding connecting blocks, the turnover plate 21 is inserted into the groove and connected with the passive disc chuck 26 through thread. The turnover plate 21 drives the passive disc chuck 23 to rotate in the second seat 12.

The turnover clamp further includes a locating piece, which fixes the passive disc chuck 26 on the second seat 12. The locating piece includes an end cover 27, which is detachably connected with the passive disc chuck 26 through a fastening piece 29, wherein one end of the end cover 27 presses against the second seat 12.

According to one embodiment of the disclosure, the end cover 27 is fixed on one end of the passive disc chuck 26 through a screw 29; when the plate 21 is turned over, the screw 29 is loosened, so that the turnover plate 21 can drive the passive disc chuck 26 to freely rotate in any angle. When a preset angle is reached, by tightening the screw 29, the end cover 27 is connected with the passive disc chuck 26 and one end of the end cover 27 tightly presses against the second seat 12, so that the passive disc chuck 26 is fixed relative to the second seat 12, that is, the turnover plate 21 and the sand billet 40 fixed thereon are fixed. Preferably, in this embodiment, the locating piece further includes a locating pin 28; a locating pin hole is arranged on the passive disc chuck 26, and the locating pin 28 is pluggable arranged in the locating pin hole. There is a plurality of the locating pin holes and an included angle is set between the locating pin holes.

Figure 4:
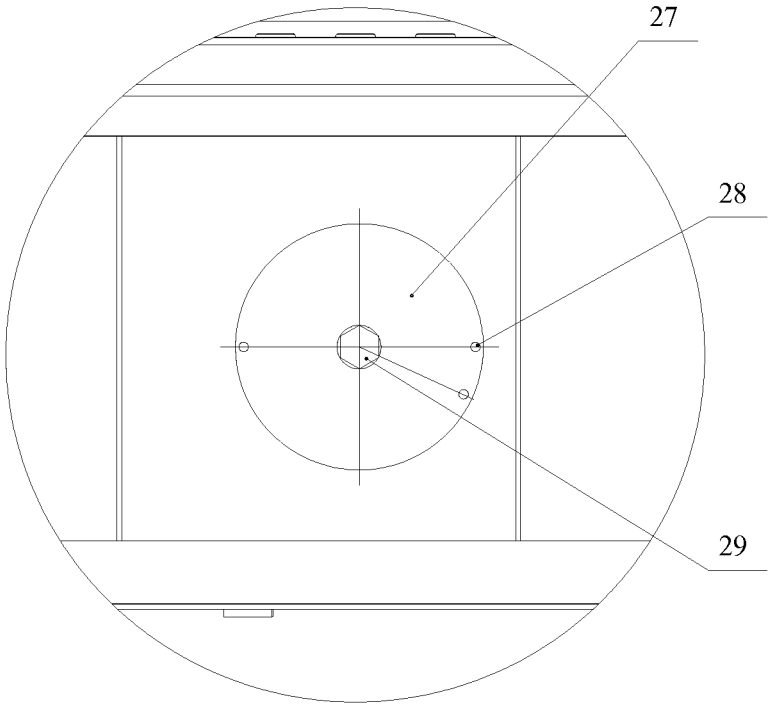
FIG. 4 shows a partial enlarged diagram of a lateral-view structure of the turnover mechanism of the forming machine without pattern casting of the disclosure.
Figure 5:
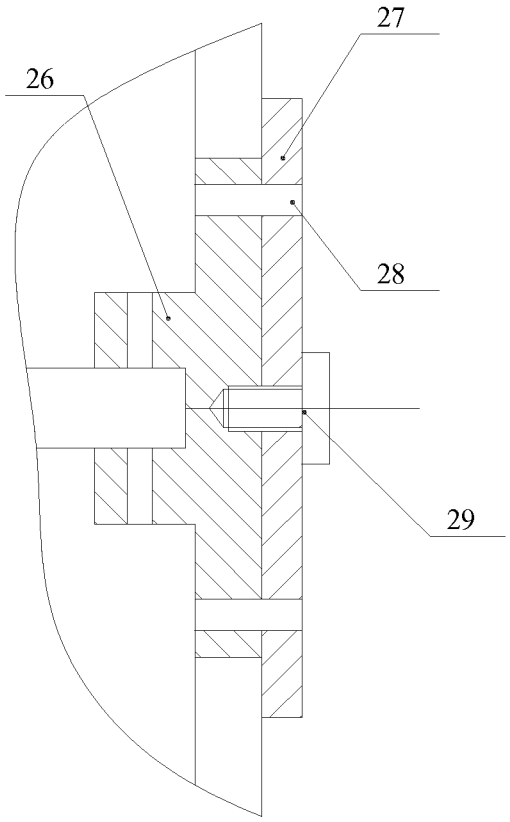
FIG. 5 shows a partial section structure diagram of FIG. 4.

As shown in FIG. 4, in this embodiment, the end cover 27 is provided with three locating pin holes 28, wherein a first locating pin hole and a second locating pin hole are of 180 degrees and are bilateral symmetrical; the included angle between a third locating pin hole and the central line of the passive disc chuck 26 is consistent with the tilt angle of the machine. When the opposite side of the sand billet 40 needs to be machined, the handle 24 can be turned to drive the active disc chuck 23 to rotate. When the first locating pin hole and the second locating pine hole on the passive disc chuck 26 are totally overlapped, a locating pin 28 is inserted into the first locating pin hole and the second locating pine hole respectively. At this time, the rotating degree is reached 180, that is, the turnover plate 21 rotates 180 degrees. In this way, once positioning and double-side machining are realized, and the inevitable error caused by two times of positioning is reduced. When it is needed to mount/demount the sand billet 40, the handle 24 is turned to drive the active disc chuck 23 to rotate; when the second locating pin hole on the passive disc chuck 26 turns to the position of the third locating pin hole, the locating pin 28 is inserted, at this time, the turnover plate 21 is just parallel to the ground, being convenient for a forklift to mount/demount the sand billet 40.

According to other embodiments of the disclosure, the end cover 27 is always fixedly connected with the passive disc chuck 26, wherein a plurality of pin holes are arranged on the end cover 27 and the second seat 12. Therefore, after the end cover 27 rotates by a certain angle, pins are inserted into the pin holes on the end cover 27 and the second seat 12 to locate the end cover 27 and the second seat 12.

In order to position the sand billet 40 conveniently, the turnover plate 21 is designed as a C-shaped plate with a through groove on one side as an opening. A sand billet fastening clamp is arranged on the turnover mechanism 20, and the sand billet 40 is fixed on the turnover mechanism 20 through the sand billet fastening clamp. Specifically, the sand billet 40 is arranged in the opening of the C-shaped plate through the sand billet fastening clamp. Since one side of the turnover plate 21 has a hollow part, waste sand grains generated after billet machining directly fall onto the baseplate 81 from this hollow part under the effect of gravity, and will not accumulate on the turnover plate 21, thereby being favourable to improve machining precision and prevent contamination caused by sand grains flying.

Figure 6:
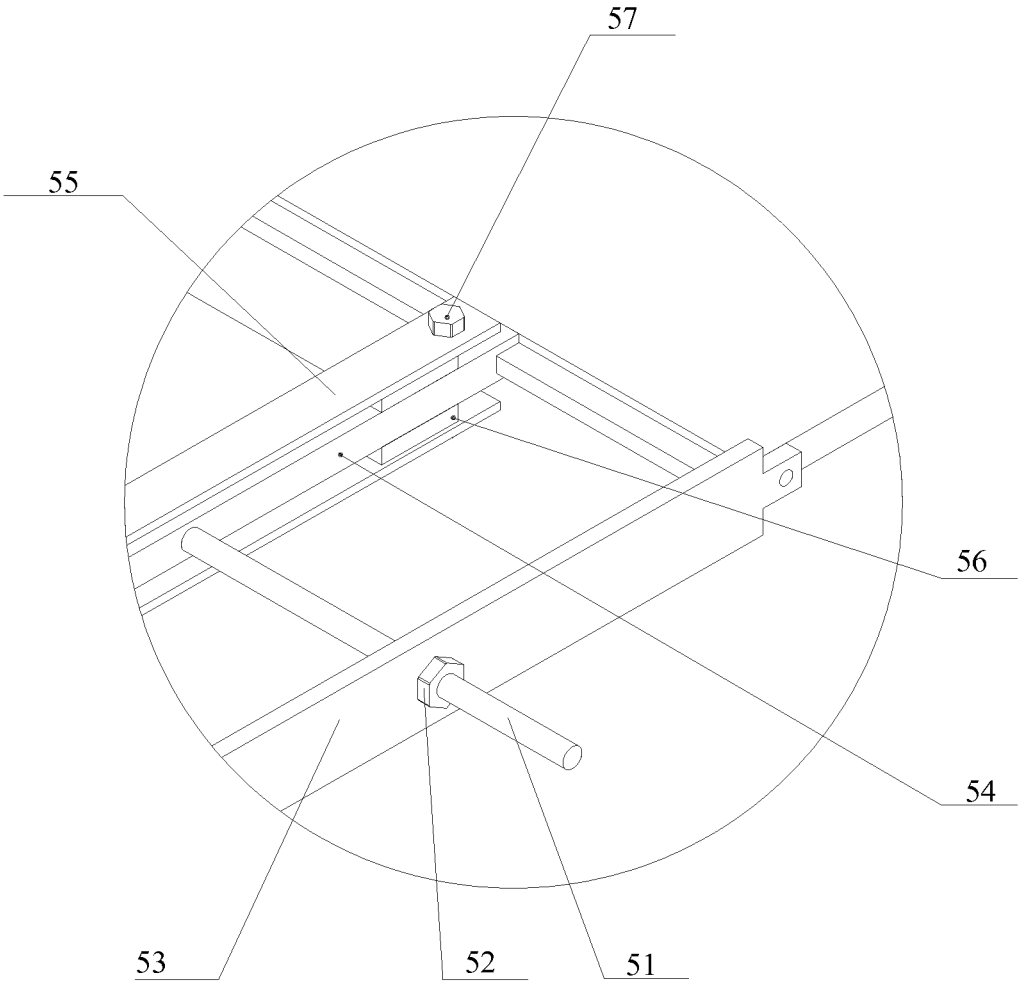
FIG. 6 shows a partial enlarged structure diagram of FIG. 2.

As shown in FIG. 2 and FIG. 6, a slide way is arranged on the turnover plate 21; a slide plate 54 can slide on the slide way linearly. One side of the turnover plate 21 is fixedly mounted with an end connecting plate 53 through a bolt, which fixes the sand billet fastening clamp on the turnover plate 21 of the turnover mechanism 20.

As shown in FIG. 6, the middle of the end connecting plate 53 is provided with a lead screw 51 and a nut 52, wherein one end of the lead screw 51 passes through the end connecting plate 53 and is braked by the nut 52, while the other end of the lead screw 51 is directly fixed on the slide plate 54. The sand billet 40 is tightly pressed between the slide plate 54 and the turnover plate 21 as the rotation of the lead screw 51; two sides of the sand billet 40 are provided with two pressure plates 55 on the upper and lower parts respectively, wherein a pressure block 56 is arranged between the pressure plate 55 and the slide plate 54, and between the pressure plate 55 and the turnover plate 21; the pressure plate 55 is fixed on the slide plate 54 and the turnover plate 21 through a bolt connection mechanism 57 respectively. When the sand billet 40 is lift to the middle of the turnover plate 21 through a forklift, the lead screw 51 is turned first so that the slide plate 54 moves until the sand billet 40 is just clamped between the slide plate 54 and the turnover plate 21; then the brake nut 52 is fixed. Then, the pressure plate 55 and the pressure block 56 are mounted on the upper and lower parts of two sides of the sand billet 40 and are fixed through the bolt connection mechanism 57. In this way, the mounting and positioning of the entire billet 40 are ensured.

In this embodiment, both the slide plate 54 and the pressure plate 55 are plane plates, which can protect the edge and corner of the sand billet while fixing the sand billet, thereby preventing the crack or damage of the sand billet.

Figure 7:
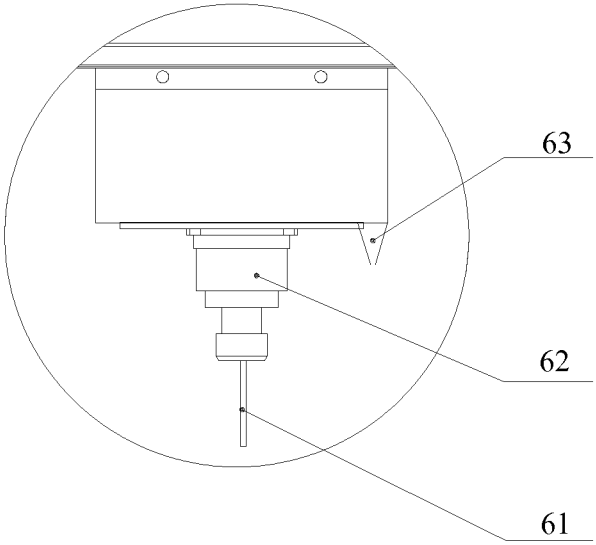
FIG. 7 shows a partial enlarged structure diagram of FIG. 1.

As shown in FIG. 1 and FIG. 7, the cutting system 60 includes a machining spindle 35 arranged at the lower end of the Z-axis motion system and a cutting tool 36 arranged at the lower end of the cutting spindle 35.

The machining spindle 35 is fixedly mounted at the lower end of the Z-axis motion system 33 through a bolt; the cutting tool 36 is fixedly mounted at the lower end of the machining spindle 35; and the machining spindle 35 could be rapidly positioned under the driving of the Z-axis motion system 10. In this embodiment, the machining spindle 35 is an electric spindle, which can drive the cutting tool 36 fixed at the lower end thereof to rotate at high speed, thereby realizing the machining of the sand billet 40.

Preferably, the forming machine without pattern casting further includes a sand blowing nozzle 34, which is arranged at the lower end of the Z-axis motion system 33, at one or two sides of the machining spindle 35.

The sand blowing nozzle 34 is fixed arranged at the lower end of the Z-axis motion system 33, on the same end face as the machining spindle 35, wherein there is one or more sand blowing nozzles. In this embodiment, two sand blowing nozzles are provided, which are arranged at two sides of the shaft end of the machining spindle 35. When the machining spindle 35 moves to a to-be-machined position under the driving of the Z-axis motion system, the sand blowing nozzle also moves to the to-be-machined position simultaneously with the Z-axis motion system 33, and blows generated sand grains away the machining position when the cutting tool 36 machines the sand billet 40, thereby being favorable to machine the sand billet.

From the description above, it can be seen that the embodiments of the disclosure mentioned above achieve the following technical effects.

Since the forming machine without pattern casting of the disclosure adopts a tilting type and needs no working platform, most of the waste sand grains generated from cutting fall freely into the shakeout groove arranged below the fixing seat, and will not fly into the multi-axis motion system, and will not cause stop failure; thus the precision and service life of the forming machine without pattern casting are improved. Meanwhile, the adoption of turnover mechanism realizes double-side or multi-side machining of sand billet, and thus well solves the problem of error caused by multiple times of positioning if the sand billet needs multi-side machining in conventional art.

The above are only the preferred embodiments of the disclosure and not intended to limit the disclosure. For those skilled in the art, various modifications and changes can be made to the disclosure. Any modification, equivalent substitute and improvement made within the spirit and principle of the disclosure are deemed to be included within the scope of protection of the disclosure.

What is claimed is:

1. A forming machine without pattern casting, comprising:

a multi-axis motion system (30);

a cutting system (60), connected with the multi-axis motion system (30);

a driving system (70), driving the multi-axis motion system (30) to move; and a machining base, wherein the machining base comprises a fixing seat (10) and a turnover mechanism (20), wherein the turnover mechanism (20) is revolvably connected with the fixing seat (10), wherein the forming machine without pattern casting further comprises a forming machine base (80) which comprises a baseplate (81) and a pedestal (82), wherein the baseplate (81) is arranged at a lower end of the fixing seat (10) and the baseplate (81) is obliquely arranged on the pedestal (82).

2. The forming machine without pattern casting according to claim 1, wherein the baseplate (81) comprises a mounting plate (84) arranged at the lower end of the fixing seat (10), and comprises a front mounting plate (87) and a back mounting plate (83) arranged at both sides of the mounting plate (84) respectively.

3. The forming machine without pattern casting according to claim 1, further comprising a outer cover (90) which is fixedly connected on the baseplate (81), wherein a sealed cavity is formed inside the outer cover (90); the multi-axis motion system (30), the cutting system (60) and the driving system (70) all are arranged in the cavity.

4. The forming machine without pattern casting according to claim 1, wherein the turnover mechanism (20) comprises a turnover plate (21) and a turnover clamp; one end of the turnover clamp is connected with the turnover plate (21), another end of the turnover clamp is revolvably connected with the fixing seat (10).

5. The forming machine without pattern casting according to claim 4, wherein the fixing seat (10) comprises a first seat (11) and a second seat (12); the turnover clamp comprises an active disc chuck (23), a first end of the active disc chuck (23) is fixedly connected with the turnover plate (21) and a second end of the active disc chuck (23) is revolvably inserted into a first disc mounting hole of the first seat (11).

6. The forming machine without pattern casting according to claim 5, wherein the second end of the active disc chuck (23) is provided with a handle (24).

7. The forming machine without pattern casting according to claim 4, wherein the fixing seat (10) comprises a first seat (11) and a second seat (12); the turnover clamp comprises a passive disc chuck (26), a first end of the passive disc chuck (26) is fixedly connected with the turnover plate (21) and a second end of the passive disc chuck (26) is revolvably inserted into a second disc mounting hole of the second seat (12).

8. The forming machine without pattern casting according to claim 7, wherein the turnover clamp further comprises a locating piece, which fixes the passive disc chuck (26) onto the second seat (12).

9. The forming machine without pattern casting according to claim 8, wherein the locating piece comprises an end cover (27), which is detachably connected with the passive disc chuck (26) through a fastening piece (29); one end of the end cover (27) presses against the second seat (12).

10. The forming machine without pattern casting according to claim 9, wherein the locating piece further comprises a locating pin (28); a locating pin hole is arranged on the passive disc chuck (26) and the locating pin (28) is pluggable arranged in the locating pin hole.

11. The forming machine without pattern casting according to claim 10, wherein there is a plurality of the locating pin holes, and an included angle is set between the locating pin holes.

12. The forming machine without pattern casting according to claim 4, further comprising a sand billet (40), wherein the turnover mechanism (20) is provided with a sand billet fixing clamp; and wherein further the sand billet fixing clamp fixedly arranges the sand billet (40) on the turnover mechanism (20).

13. The forming machine without pattern casting according to claim 4, further comprising a sand billet (40), wherein the turnover plate (21) is a C-shaped plate with an opening on one side; and wherein further the sand billet (40) is fixedly arranged in the opening of the C-shaped plate.

* * * * *